United States Patent [19]

Satake

[11] 4,324,175

[45] Apr. 13, 1982

[54] APPARATUS FOR RICE POLISHING

[75] Inventor: Toshihiko Satake, Higashi Hiroshima, Japan

[73] Assignee: Satake Engineering Co. Ltd., Tokyo, Japan

[21] Appl. No.: 92,018

[22] Filed: Nov. 7, 1979

Related U.S. Application Data

[63] Continuation-in-part of Ser. No. 872,077, Jan. 25, 1978, abandoned.

[30] Foreign Application Priority Data

Apr. 1, 1977 [JP] Japan ..... 52/37933

[51] Int. Cl.[3] ..... B02B 3/04; B02B 3/12

[52] U.S. Cl. ..... 99/519; 99/520; 99/524; 99/526; 99/528; 99/531

[58] Field of Search ..... 99/516, 518, 520–522, 99/525–526, 528, 568, 602–606, 612–614; 426/461, 507, 482, 483, 511

[56] References Cited

U.S. PATENT DOCUMENTS

| | | | |
|---|---|---|---|
| 155,300 | 9/1874 | Grubb | 99/518 |
| 431,785 | 7/1890 | Short | 99/613 |
| 677,347 | 7/1901 | Ewan | 99/613 |
| 728,604 | 5/1903 | Overbeck | 99/525 |
| 1,220,090 | 3/1917 | Gmeinder | 99/521 |
| 3,401,731 | 9/1968 | Wayne | 99/518 |
| 3,485,280 | 12/1969 | Satake | 99/614 |

*Primary Examiner*—Philip R. Coe
*Assistant Examiner*—Timothy F. Simone

[57] ABSTRACT

Apparatus is disclosed for polishing rice grains for generating super luster on rice grain surfaces which comprises means for grind-polishing rice grains from unpolished rice grains into intermediately polished rice grains whereby the yield of said intermediately polished rice grains from said unpolished rice grains is maintained equal to or not less than approximately 94%. The present invention also includes structure for feeding 2–50 kg of water per hour and 12–90 $m^3$ air per hour to intermediately polished rice grains that are flowing at a rate of one ton per hour whereby moisture of 0.1–2.0 weight percent to the rice grains, weight is absorbed and stuck onto surfaces of the rice grains during friction-polishing. The disclosed rice polishing apparatus includes a grinding-type polishing machine provided with grinding type polishing rolls and a humidified friction-type polishing machine provided with friction type polishing rolls and humidifying device.

7 Claims, 1 Drawing Figure

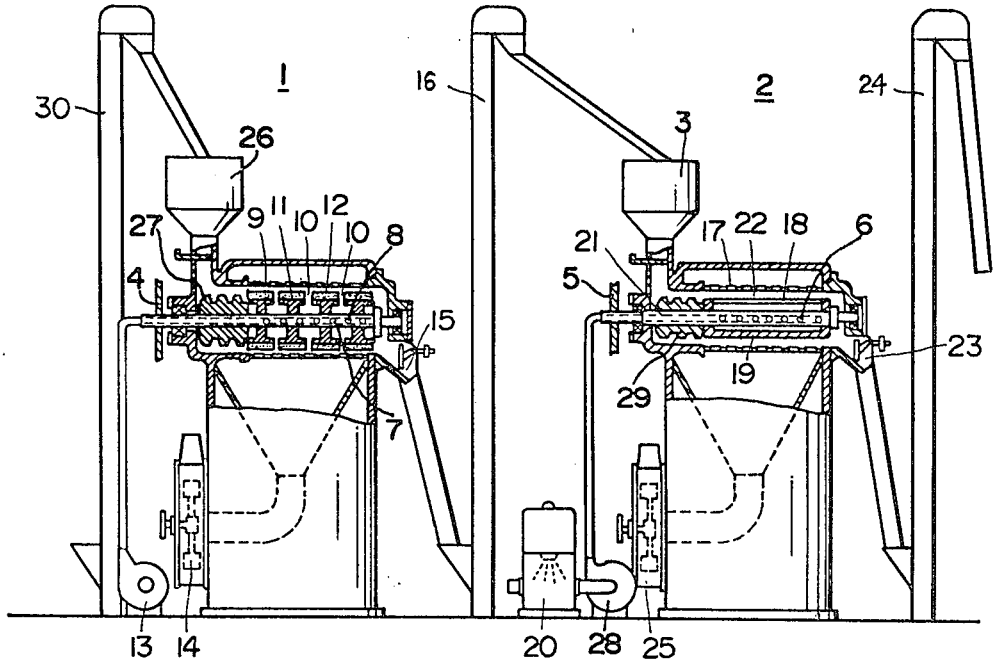
1
2
30
16
24
26
3
27
9
11
10
12
10
8
21
17
22
18
6
4
5
15
23
19
29
7
13
14
20
28
25

APPARATUS FOR RICE POLISHING

CROSS-REFERENCE TO PRIOR APPLICATION

This application is a continuation-in-part application of Ser. No. 872,077 filed Jan. 25, 1978, abandoned.

FIELD OF THE INVENTION

The present invention relates generally to rice polishing apparatus and, more particularly, to rice polishing apparatus including a grinding-type polishing machine provided with grinding-type polishing rolls and a humidified friction-type polishing machine provided with friction-type polishing rolls and a humidifying device.

PRIOR ART

Some conventional rice polishing structure wherein moisture is added into a rice polishing chamber have been hitherto known. However, all of these structures have been adopted merely for the purpose of softening the surface of the rice grain to improve polishing efficiency or for the purpose of adding moisture to the rice grain to increase the moisture content and consequently, it has been impractial to finish polishing the rice grain into a super-polished state.

One such form of prior art is shown, for example, in Japanese Utility Model Publication No. 17171/59, but, the structure disclosed therein merely shows means for supplying moisturized air into a rice polishing chamber in order to moisten the surface of rice grain so as to improve, to some extent, the polishing efficiency. However, super-polished, very white rice cannot be obtained by this prior art structure.

SUMMARY OF THE INVENTION

An object of the present invention is to provide novel rice polishing apparatus which enables rice grains to be polished into a super-polished state very efficiently without using any additive materials. Hitherto, it has been impossible to produce super-polished rice unless some lustrous agent such as talc is coated thereon.

Using the rice polishing apparatus according to the present invention, the rice to be polished is polished at first from an unpolished state into an intermediate polished state by a grinding process whereby approximately 94% of intermediately polished rice grains is obtainable out of unpolished rice grains. Then approximately 2–50 kg per hour of water accompanied by approximately 12–90 $m^3$/hour of air is supplied into one ton per hour of said intermediately polished rice grains. Thus, substantial moisture in the range of 0.1–2.0% of the weight of rice grains is stuck to and absorbed by the surface of the rice grains thus enabling proper softening and the provision of a super finished lusture over the surface of the rice grains by friction polishing.

Therefore, the process of polishing rice grains is effectively carried out and yet the generation of broken rice grains is very little. In addition, scars are added to the rice grain surfaces. Accordingly, moisture rapidly penetrates into intermediately polished rice grains in the next step of humidified frictional polishing, and the frictional polishing of the intermediately polished rice grains is carried out while water is supplied thereto. In the last finishing stage of the rice-polishing process, it is possible to remove aleuron layers in slots in the longitudinal direction existing in the rice grains in order to make the whole rice grain surface into a super lustrous state due to super flat surfaces thereof. The apparatus according to the instant invention provides a humidified polishing process which has a humidified rice bran removing, ventilating and polishing effect. The present apparatus does not require any strongly pressurized frictional polishing as a preliminary stage of polishing. It humidifies roughly and intermediately polished surfaces of rice grains as very thin humid layers, and the rice bran powder generated by the frictional polishing is immediately removed by air. Thus, rice grains are finally polished in a super lustrous state. Therefore, the yield of polished rice grains and polishing efficiency are improved and broken rice grains are reduced by employing grinding-polishing as a preliminary stage of humidified polishing and perfect white grains having super luster are produced.

In this case, the removal of such moisture-containing rice bran powder generated by air flow should be carried out as quickly as practicable, otherwise the viscous rice bran powder would stick to the surfaces of the rice grain and bring about such an unfavourable effect as spoiling surfaces instead of generating proper luster and therefore, the amount of air flow for removing moisture and rice bran should be limited as an inevitable requirement. However, approximately 50% of the total quantity of the moisture thus fed is discharged out of the polishing chamber together with the air and this loss is subjected to fluctuation in accordance with the air flow as well.

The rice grain polishing apparatus according to the present invention comprises a grinding-type grain polishing machine having a grinding-type polishing chamber therein which is provided with grinding-type polishing rolls within a porous-walled polishing cylinder and a friction-type rice grain polishing machine enclosing therewith a humidifying-type polishing chamber provided with friction rolls for polishing rice grain. A ventilator device for removing rice bran and a moisture-adding device are arranged for the purpose of obtaining high productivity and high efficiency for producing super lustered rice grains by association of both rice grain polishing machines to complete a synthetic uniflow operational process.

BRIEF DESCRIPTION OF THE DRAWING

The accompanying drawing shows a partly sectional view of the rice grain polishing apparatus of an embodiment according to the present invention.

DETAILED DESCRIPTION OF A PREFERRED EMBODIMENT

A detailed description of the present invention will now be given with reference to the drawing. In the drawing, a grinding-type rice grain polishing machine 1 comprises a porous wall rice polishing chamber 9 and a plurality of grinding-type polishing rolls 11 provided therein whereby a polishing chamber 12 is provided therebetween. The grinding-type polishing rolls 11 are driven at a relatively high speed in order to rapidly produce intermediately polished rice grains. A hollow shaft 8 having a plurality of air holes 7 is in communication with a blower 13 and also with air holes 10. An air discharger 14 is fluidly connected with the outer circumference of the porous wall rice polishing cylinder 9. A rice grain discharge opening 15 of the grinding type, rice polishing machine 1 is connected with the lower end of an elevator 16 of which the upper end is connected to a feeding hopper that is a feeding part of a humidifying friction-type rice grain polishing machine 2. Therefore, the rice grain discharge opening 15 is connected with the feeding part of the friction-type, rice polishing machine 2. A pulley 4 is fixed to the hollow shaft 8. Another elevator 30, a rice grain feeding hopper 26 and a feed screw 27 are provided in the grinding-type rice grain polishing machine 1.

The humidifying friction-type rice grain polishing machine 2 comprises a friction-type polishing roll 19 provided within a porous wall rice grain polishing cylinder 17. The roll 19 also includes at least one slot 18 that is elongated along the longitudinal direction thereof and is approximately the same diameter as the grinding-type polishing rolls 11. A moisture adding device 20 is connected with ventilation slots 18 through a blower 28 and holes 6 in the wall of a hollow shaft 21 which is driven independently of and at a relatively slower speed than the hollow shaft 8 that supports the plurality of grinding-type polishing rolls 11 in the grinding-type rice grain polishing machine 1 in order to produce the super-lustered white rice slowly. A polishing chamber 22 and an air discharging fan 25 are connected through the porous wall rice grain polishing cylinder 17. A rice grain discharge opening 23 is connected to a lower part of an elevator 24. A pulley 5 provided on the hollow shaft 21 and a feed screw 29 are also included in the humidifying friction-type rice grain polishing machine 2.

Next, the operation of the above mentioned embodiment will be described.

At first, the rice grains to be polished are fed by the elevator 30 through the feeding hopper 26 of the grinding-type polishing machine 1 into the grinding-type polishing chamber 12 within the porous wall rice polishing cylinder 9. Then, the hollow shaft 8 is turned by means of the driving pulley 4. The blower 13 is turned by means of the driving pulley 4. The blower 13 and the air discharging machine 14 are also driven thereby. Accordingly, the rice grains to be polished are driven by the feed screw 27 that is mounted on the hollow shaft 8 in the grinding-type polishing chamber 12 and polished by grinding with the grinding-type polishing rolls 11. At this time, the rice bran is torn off the rice grains by air blown from the air holes 10 of the grinding-type polishing rolls 11 and discharged outwardly through the porous wall of the porous wall rice polishing cylinder 9 due to the discharging air generated by the discharging machine 14. Then, the intermediately polished rice grains are fed from the discharge opening 15 to the lower end of the elevator 16 and are lifted thereby. The rice grains are then guided from the top of the elevator 16 into the feeding hopper 3 of the humidifying friction-type rice grain polishing machine 2.

In the humidifying friction-type rice grain polishing machine 2, the hollow shaft 21 is rotated by means of the pulley 5 and the blower 28 is operated as well, whereby air containing moisture generated in the humidifying device 20 is blown out into the polishing chamber 22 from holes 6 of the hollow shaft 21 through the slots 18 of the friction-type polishing rolls 19. When the air discharge fan 25 is operated, the intermediately polished rice grains, which have been provided with scars on their surfaces by grinding and which have been guided into the feed hopper 3 and then driven into the humid polishing chamber 22 by the feed screw 29 which is rotated with the hollow shaft 21 whereby frictional polishing of the rice grains is carried out by the friction-type polishing roll 19 within the perforated polishing cylinder 17, have moisture supplied onto the surfaces thereof. At this time aleuron layers which stuck to the scars in the longitudinal direction of the rice grains, and which are hard to remove by grinding-polishing are softened because of the addition of moisture. At the same time, frictional type of operation is carried out under strong ventilation. Then the humid rice bran generated thereby, in association with the final polishing, is discharged through the perforated polishing cylinder 17 and taken out of the machine 2 by the absorbing action around the perforated polishing cylinder 17 connecting with the discharge fan 25, where water at the rate of 2–50 kg per hour and air at the rate of 12–90 $m^3$ per hour are fed to the rice grains flowing at a rate of one ton per hour, and moisture of 0.1–2.0% of the weight of the rice is stuck and absorbed during the friction polishing, thus enabling the surfaces of the rice grain to generate super lusture.

I claim:

1. A rice grain polishing apparatus comprising the combination of:

(A) a grinding-type grain polishing machine including:
- (a) inlet means for unpolished rice grains;
- (b) feed screw means for advancing the unpolished rice grains,
- (c) a plurality of axially spaced apart, grinding-type polishing rolls of the type capable of providing a large number of scars on the surface of the rice grains to thereby partially polish them and to permit the rapid addition of moisture on the surface thereof;
- (d) a first tubular, rotatable shaft having a perforated wall commonly supporting and driving said polishing rolls at a first speed, there being further included means for blowing air through the holes in the wall of said first shaft;
- (e) a porous wall surrounding said grinding polishing rolls and defining a grinding-type polishing chamber therewith for receiving the air blown through the walls of said first shaft; and
- (f) outlet means for the partially polished rice grains; and (B) a humidifying friction-type rice grain polishing machine including;
- (a) inlet means for receiving the partially polished rice from said outlet means in said grinding-type polishing means;
- (b) feed screw means for advancing the partially polished rice grains;
- (c) at least one hollow friction-type polishing roll having at least one opening through the wall thereof;
- (d) a second tubular shaft independent of said first shaft in said grinding-type polishing machine for supporting and driving said at least one friction type polishing roll at a second speed that is slower than said first speed, said second shaft of said friction-type polishing machine being hollow and the wall thereof being perforated, there being further included means for blowing air through the perforations in the wall of said second shaft in said friction-type polishing machine;
- (e) a porous wall surrounding said friction-type polishing roll and defining a friction-type polishing chamber therewith for receiving air blown through the wall of said second tubular shaft in said friction-type grain polishing machine;

(f) means for delivering humid air only into said friction-type polishing chamber whereby the scratched, partially polished rice grains in said friction-type chamber in said friction-type grain polishing machine are impregnated with the humid air and the humid air impregnated rice grains are completely polished to a superluster; and (g) outlet means for the completely polished rice grains.

2. The rice grain polishing apparatus according to claim 1 wherein said grinding-type polishing rolls and said feed screw means are mounted on said first shaft.

3. The rice grain polishing apparatus according to claim 1 wherein said friction-type polishing roll and said feed screw means are mounted on said second shaft.

4. The rice grain polishing apparatus according to claim 1 wherein there is further included ventilating means for blowing air diametrically across and through said grinding-type polishing rolls, said polishing chamber and said surrounding porous wall in said grinding-type grain polishing machine.

5. The rice grain polishing apparatus according to claim 1 wherein there is further included ventilating means for blowing air diametrically across and through said friction-type polishing roll, said polishing chamber and said surrounding porous wall in said friction-type grain polishing machine.

6. The rice grain polishing apparatus according to claim 1 wherein said polishing rolls in said grinding-type polishing machine and said friction-type polishing machine are approximately the same diameter.

7. The rice grain polishing apparatus according to claim 1 wherein said at least one opening in said hollow friction-type polishing roll is a longitudinally extending slot.

* * * * *